United States Patent [19]

Sullivan

[11] Patent Number: 4,574,399

[45] Date of Patent: Mar. 11, 1986

[54] FLUSHING, TOILET TANK-FED, PRIMER VALVE FOR SEWER LINE DRAIN TRAPS

[76] Inventor: Richard N. Sullivan, 7911 SE. 82nd Sp. 40, Portland, Oreg. 97266

[21] Appl. No.: 701,487

[22] Filed: Feb. 13, 1985

[51] Int. Cl.[4] ..... E03C 1/24; F16K 13/00; F16K 13/10

[52] U.S. Cl. ..... 4/206; 4/197; 4/292; 4/661; 4/353; 137/247.25

[58] Field of Search ..... 4/206, 661, 353, 207, 4/422, 256, 203, 191, 197, 210, 209 R, 218, 197, DIG. 9, 415, 287, 292; 137/206, 207, 247.25, 204, 209

[56] References Cited

U.S. PATENT DOCUMENTS

| | | | |
|---|---|---|---|
| 796,848 | 8/1905 | Leanhart | 4/422 |
| 2,809,656 | 10/1957 | Goldtrap | 137/206 |
| 3,333,597 | 8/1967 | Sullivan | 137/207 X |
| 4,204,556 | 5/1980 | Sullivan | 137/206 |
| 4,218,786 | 8/1980 | Taglarino | 4/206 |

*Primary Examiner*—Henry K. Artis
*Attorney, Agent, or Firm*—Eugene D. Farley

[57] ABSTRACT

A primer valve for sewer line drain traps is adapted for use in conjunction with a flushing toilet or like installation including a tank containing water of fluctuating level. The primer valve comprises a pipe penetrating the lower portion of the tank and providing a port at its inner end. A conduit connects the outer end of the pipe to the trap. A float-operated valve is associated with the port and operative to discharge small amounts of water through the valve with changes in level of the water in the tank.

6 Claims, 3 Drawing Figures

FLUSHING, TOILET TANK-FED, PRIMER VALVE FOR SEWER LINE DRAIN TRAPS

BACKGROUND AND GENERAL STATEMENT OF THE INVENTION

This invention pertains to primer valves for dispensing small amounts of water from time to time to sewer line drain traps as required to keep them full and operative.

Since the water in sewer line drain traps evaporates with time, the traps may become non-functional, allowing sewer gas to enter the building in which the drain is housed. For this reason most municipal plumbing and sanitary codes require that means be provided for supplying primer water automatically to each sewer line water trap. This ensures the trap will be operative at all times.

My prior U.S. Pat. Nos. 3,333,597 and 4,204,556 describe primer valves for sewer line traps which hook onto the domestic pressured water system.

It is the general purpose of the present invention to provide a primer valve for sewer line drain traps which, rather than hooking onto the pressured domestic water system, is fed by water from the tank of a flush toilet, or similar installation incorporating a tank containing water of fluctuating level. Each time the toilet is flushed, a small but effective amount of water is fed through the primer valve to the sewer line drain trap.

It is a further purpose of the present invention to provide an automatic primer valve for sewer line drain traps which is simple in construction, adaptable for use with conventional flushing toilets, easily and inexpensively installed, and substantially free of maintenance problems.

The foregoing and other objects of the invention are accomplished by the provision of a primer valve for sewer line drain traps which is adapted for use in conjunction with a flushing toilet or like installation including a tank containing water of fluctuating level. The primer valve comprises a pipe penetrating the lower portion of the tank and providing a port at its inner end. Conduit means connect the outer end of the pipe to the trap. Seal means seal the joint between the pipe and tank against leakage of water. A float-operated valve is associated with the port and is actuated preferably by the toilet tank float. The valve is operative to discharge small amounts of water to the trap with changes in level of the water in the tank. The device thus makes use of surplus water contained in the tank without drawing specifically on the pressurized household water supply.

DESCRIPTION OF A PREFERRED EMBODIMENT OF THE INVENTION

Figure 1:
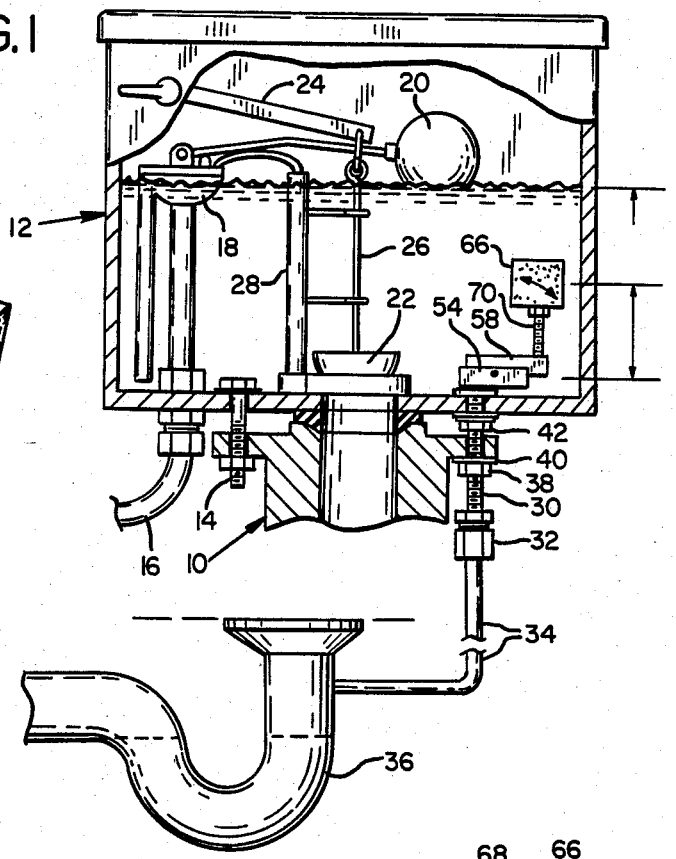
FIG. 1 is a vertical sectional view of a flush toilet assembly, partly fragmentary, with the herein described sewer line drain trap primer valve mounted therein.
Figure 2:
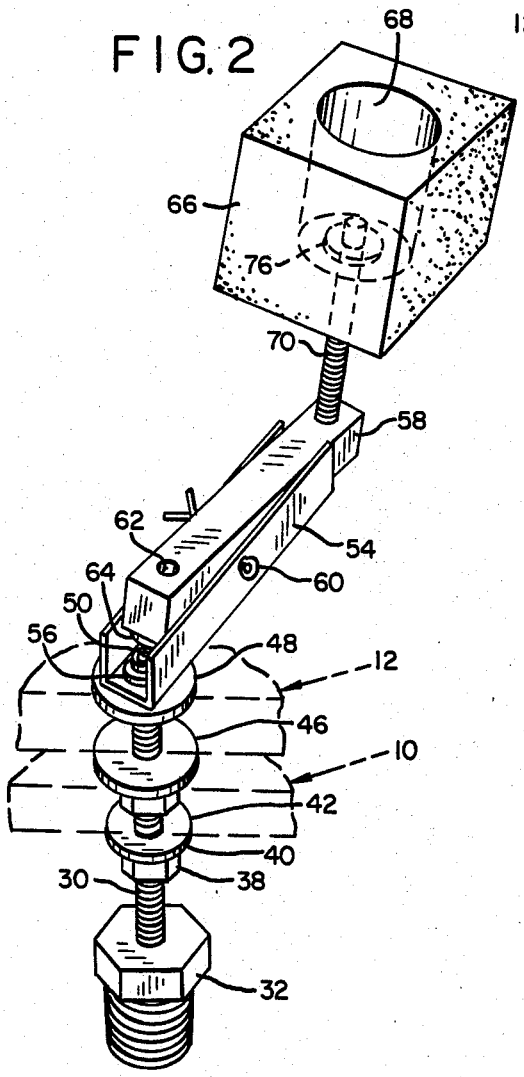
FIG. 2 is a top perspective view of the primer valve assembly.

As shown in FIG. 1, the automatic primer valve of my invention is adapted for use particularly with a conventional flush toilet, without substantial modification thereof.

The flush toilet comprises a toilet bowl, indicated fragmentarily at 10, with communicating tank 12. The tank is coupled to the bowl by means of bolts, a conventional one of which is shown at 14.

In the usual manner, the house water line 16 is coupled to a vertical pipe within the tank and the flow of water controlled by means of a float-operated valve 18 mounted on the upper end of the pipe and operated by means of float 20. Water is discharged to the bowl by means of the conventional ball valve 2 operated by means of lever 24 and connecting link 26. Overflow water is vented through discharge pipe 28.

In the presently described primer valve assembly, a conventional coupling bolt 14 is replaced with a special hollow bolt 30 which serves the dual functions of coupling the tank to the toilet bowl and of providing a discharge pipe for the discharge of small increments of priming water from the tank to the sewer line trap upon each flushing operation of the toilet. In the usual case, this bolt is installed vertically to permit gravitational flow of water through its hollow interior.

The outer end of hollow bolt or pipe 30 is coupled by means of a suitable coupling 32 to pipe 34. The latter in turn communicates with trap 36, to which it supplies priming water. Hollow bolt 30 mounts a lower nut 38 with associated washer 40 to assist in coupling the tank to the bowl.

Seal means are provided to seal the joint between the hollow bolt or pipe 30 and tank 12.

Figure 3:
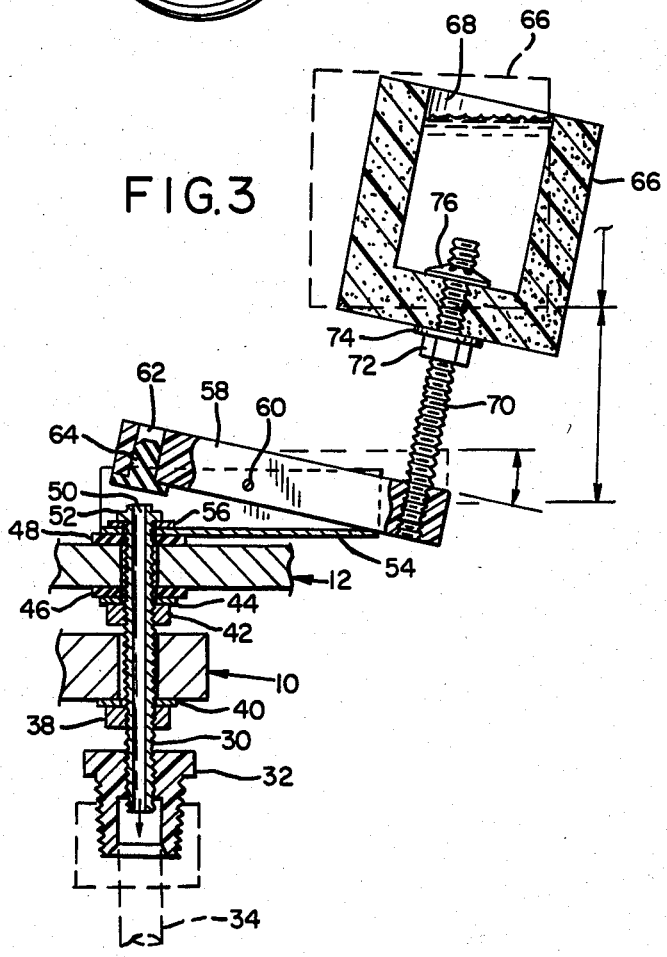
FIG. 3 is a longitudinal sectional view of the primer valve assembly.

As shown particularly in FIG. 3, the seal means comprises a nut 42 with associated washer 44 and seal 46 on the underside of the tank 12 and a seal 48 on the upper or inner side of tank 12.

The upper open end of hollow bolt 30 thus provides a port 50. Also, it is formed with an integral flange 52, as shown particularly in FIG. 3. Further it serves as a support for the herein described primer valve assembly.

To this end, there is provided in the assembly a base member 54 which preferably is channel shaped in cross section. The bottom of the channel support is perforated to accommodate the upper end of hollow bolt 30. A washer 56 is interposed between channel supports 54 and flange 52. Tightening down on nut 42 accordingly not only seals the joint between the hollow bolt and the tank, but also mounts channel support 54.

Mounted on channel support 54 is valve means for intermittently supplying water to the interior of hollow bolt 30 via its port 50.

The valve means comprises a rocker arm 58 positioned inside the channel support longitudinally thereof. Pivot means mount the arm intermediate its ends for oscillating one end of the arm between first and second, or raised and lowered, positions.

The pivot means employed for this purpose comprises a pin 60 penetrating the side walls of the channel support and the arm at a location centrally thereof. For ease of assembly and disassembly, the pin may comprise a cotter key.

One of the ends of rocker arm 58, i.e. the left hand end as viewed in FIG. 3, has a transverse bore 62 in which is seated a seal member 64. The latter may be formed with an extension which fits frictionally within bore 62 for easy insertion, renewal, and adjustment. Its outer or operative face in the down position of arm 58 seals off port 50. However, in the raised position of arm 58, port 50 is open to receive a flow of water from within the tank.

The valve assembly is driven between open and closed positions by a float 66 which preferably comprises a block of flotation material, such as styrofoam, having in its interior a recess 68 which opens upwardly and outwardly to the interior of the tank. As shown in FIG. 3, it is adapted to retain a quantity of water after the tank is flushed.

Float 66 is mounted on the end of rocker arm 58 by means of a bolt 70 the lower end of which is threaded into the end of rocker arm 58 opposite valve member 62. The bolt extends upwardly and penetrates an opening in the bottom of float 66. The float then is secured by means of a lower nut 72 with associated washer 74 on the underside of the float cooperating with an upper nut, or preferably a press-on washer 76 mounted on the inner side of the float.

OPERATION

The manner of operation of the herein described sewer drain trap primer valve is as follows:

The assembly described above is mounted within the toilet tank 12 in the manner shown particularly in FIG. 3. This is accomplished by the simple expedient of replacing a conventional mounting bolt 14 (FIG. 1) with the hollow bolt 30 and its associated elements.

When the toilet tank is filled, as illustrated in FIG. 1, float 66 is elevated and shifts rocker arm 58 to its lowered position of FIG. 1, i.e. the dashed line position of FIG. 3. In this position of the arm, valve member 64 seals off port 50 so that water from the tank cannot escape through hollow bolt 30 and pipe 34.

When the toilet is flushed, the water level within the tank decreases and the rocker arm assumes its full line FIG. 3 position, with port 50 open. An increment of water, about 2 ounces in the typical installation, escapes from the tank via port 50 during the period of time the water is draining from the tank. Even though the water is completely drained from the tank, the residual water contained in reservoir 68 of float 66 serves as a weight which maintains the valve open long enough to insure that the desired amount of water escapes through the port during the tank emptying operation.

The water which escapes through port 50 passes gravitationally through the hollow interior of bolt 30 and connecting pipe 34 into trap 36, where it serves its desired function.

It is to be noted that this water is a portion of the surplus water contained in tank 12 and not water from the pressurized house line. Its use accordingly does not add anything to the water bill of the user, a matter which is of some importance in the case of a leak during the operation of a conventional primer valve attached to the pressurized water line.

Having thus described in detail a preferred embodiment of the present invention, it will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A sewer drain trap primer valve for use in conjunction with a flushing toilet tank or like installation including a tank containing water of fluctuating level, the valve comprising:
   (a) a pipe penetrating the lower portion of the tank and providing a port at its inner end,
   (b) conduit means connecting the outer end of the pipe to the trap,
   (c) seal means sealing the joint between the pipe and tank against leakage of water,
   (d) and float-operated valve means associated with the port and operative to discharge a small amount of water through the valve means with changes in level of the water in the tank.

2. A sewer drain trap primer valve for use in conjunction with a flushing toilet tank or like installation including a water-containing tank cycling between filled and emptied conditions, the valve comprising:
   (a) a water discharge pipe penetrating the lower portion of the tank and providing a port at its inner end,
   (b) conduit means connecting the outer end of the pipe to the trap,
   (c) seal means sealing the joint between the pipe and the tank against leakage of water,
   (d) an arm support positioned within the tank adjacent to the port,
   (e) an arm,
   (f) pivot means mounting the arm intermediate its ends to the arm support for oscillating one end of the arm between first and second positions,
   (g) valve means in said one end of the arm operative to close the port when the said one end of the arm is in one position, and to open the port when the said one end of the arm is in its other position,
   (h) float means, and
   (i) connecting means connecting the float means to the other end of the arm for actuating the arm with fluctuations in water level of the tank.

3. The primer valve of claim 2 wherein the toilet tank is mounted on an associated toilet bowl by means of mounting bolts, one of the bolts being hollow and comprising the water discharge pipe.

4. The primer valve of claim 3 wherein the arm support comprises a structural member secured to the upper end of the hollow bolt.

5. The primer valve of claim 3 wherein the arm support comprises a channel member receiving the arm, and the pivot means comprises pin means penetrating the channel member and the arm.

6. The primer valve of claim 2 wherein the float means has a reservoir open to the tank and positioned to receive water therefrom, the water thus received serving to weight the float as the tank empties, insuring opening of the valve.

* * * * *